United States Patent [19]

Hegemann

[11] Patent Number: 4,574,611

[45] Date of Patent: Mar. 11, 1986

[54] DEVICE FOR BENDING METAL STOCK

[76] Inventor: Kenneth J. Hegemann, Rte. 1, Box 69, Newman Grove, Nebr. 68758

[21] Appl. No.: 743,042

[22] Filed: Jun. 10, 1985

[51] Int. Cl.[4] ..... B21D 9/05

[52] U.S. Cl. ..... 72/389; 72/453.01; 72/448

[58] Field of Search ..... 72/389, 453.01, 448; 100/214, 257

[56] References Cited

U.S. PATENT DOCUMENTS 3,442,111 5/1969 Ledford et al. ..... 72/389

3,457,759 7/1969 Doerr et al. ..... 72/389

4,242,903 1/1981 Ledford et al. ..... 72/453.01

*Primary Examiner*—W. D. Bray

[57] ABSTRACT

A device for bending metal stock which utilizes a conventional die blade in conjunction with a die block formed from two bent metal plates. The plates have lower vertical portions which are parallel and space-apart to form a slot into which the die blade is inserted to bend the metal stock. The upper portions of the plates are bent outwardly to a horizontal coplanar position, forming a platform upon which the stock rests before bending.

11 Claims, 4 Drawing Figures

DEVICE FOR BENDING METAL STOCK

TECHNICAL FIELD

The present invention is generally in the field of devices for bending metal stock, and more particularly to metal bending presses having a movable die blade.

BACKGROUND ART

The procedure for bending sheet metal and flat metal stock has typically been expensive to the average consumer. The equipment was large and expensive, making it necessary for the consumer to go to a machine shop to have metal bending work performed, rather than being able to purchase his own equipment for home use.

The basic reason for the expensive cost of such equipment is in the use of a machined die block. The prior art die block has a channel cut therein to the exact angle for forming the desired angle of bend in the metal stock. The machining of the die block is an expensive process, since high-tempered steel cutters are used, and extra-strength materials must be used in the die block itself to withstand the stresses involved in bending metal stock thereon. The metal is bent by placing the piece of metal stock over the channel in the die block, and forcing a die blade to push the metal stock within the channel. This procedure is used to stamp out large quantities of pieces of metal stock, and allows the cost of the machined die block to be distributed over the cost of many bent metal pieces. However, it can be seen that it would be very expensive to bend only one or two pieces of metal stock since the cost of machining a die block would be borne by only one or a few pieces.

DISCLOSURE OF THE INVENTION

It is therefore a general object of the present invention to provide an improved device for bending metal stock.

Another object is to provide a device for bending metal with a die block which will form universal angular bends.

A further object of the invention is to provide a metal bending device which can also be used as a power press.

Yet another object is to provide a metal bending device which is easily assembled and composed of conventional, inexpensively manufactured elements.

More generally it is an object of the present invention to provide a press for bending metal stock which utilizes a conventional die blade in conjunction with a die block created from two sheets of bent metal. The two sheets of metal have uniform radius curved bends and are spaced apart to form a vertical channel therebetween into which the die blade is inserted to bend the metal stock.

These and other objects, advantages and novel features of the present invention will become apparent from the following detailed description of the invention when considered in conjunction with the accompanying drawings.

BEST MODE FOR CARRYING OUT THE INVENTION

Figure 1:
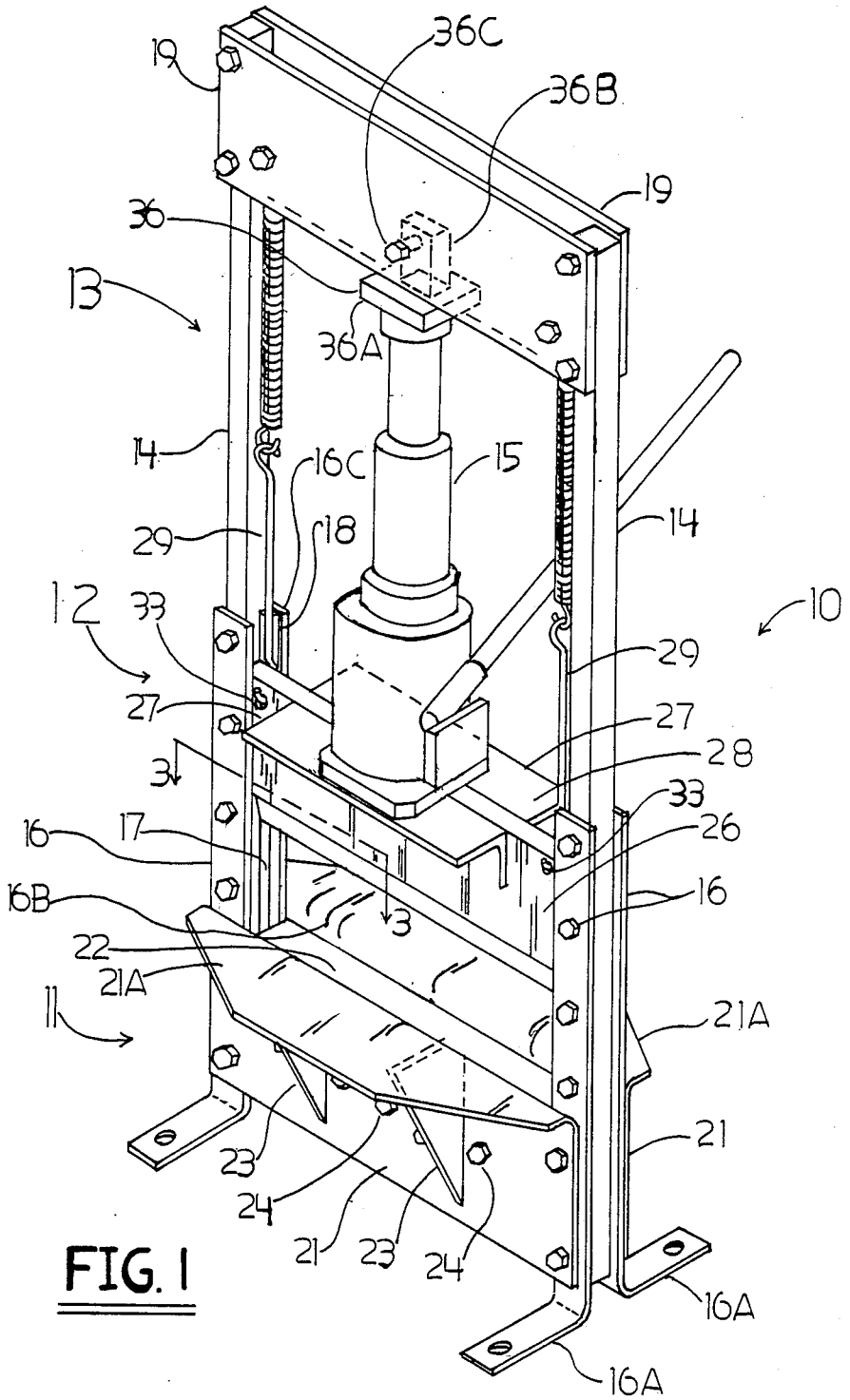
FIG. 1 is a perspective view of the invention with a conventional hydraulic jack installed therein.

Referring now to the drawings, in which identical or corresponding parts are indicated by the same reference character throughout the several views, and more particularly to FIG. 1, the metal bending device is designated generally at 10, and includes a die block assembly designated generally at 11, a die blade assembly designated generally at 12, a frame designated generally at 13, and a hydraulic jack 15 to power the invention.

Figure 3:
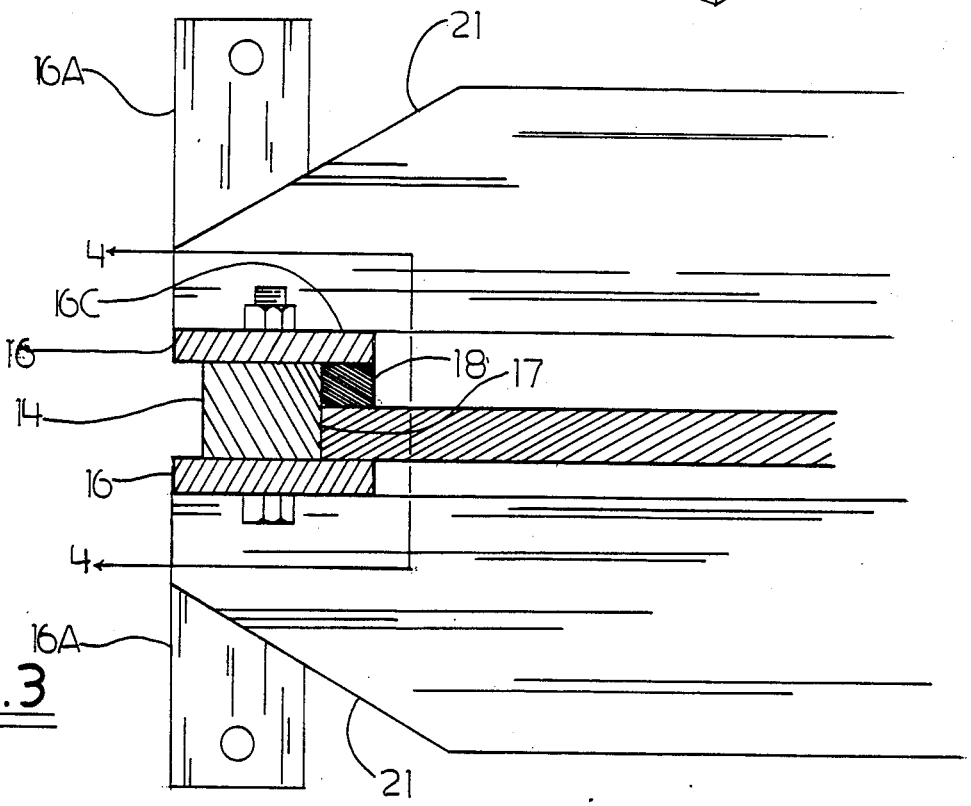
FIG. 3 is an enlarged sectional view of the invention taken at lines 3—3 in FIG. 1.

Referring now to FIGS. 1 and 3, frame 13 includes two elongated vertical and parallel side members 14, each side member 14 having a pair of bent brackets 16 mounted at their lower ends. Each bracket 16 is slightly wider than the width of side member 14, and are bolted on the front and back faces of each side member 14 such that the bent portion **16*a* project outwardly from the bottom of side members 14, forming feet. A vertical edge of each bracket projects towards the interior of frame 13, such that a channel 17 is formed between each pair of brackets 16 and side member 14 on each side of frame 13**.

An elongated rectangular spacer 18, having a width equal to that of the projecting edge of a leg bracket 16, a depth slightly less than one half the depth of a vertical side member 14, and a height slightly less than the height of a leg bracket 16, is affixed to the interior face of the projecting edge **16*c* of each rear bracket 16. Thus, channel 17 along each side member 14, is reduced in width to the distance between spacer 18, and the interior projecting edge of front brackets 16. Channels 17 will act as guides for die blade assembly 12**, described in more detail below.

Referring again to FIG. 1, a rectangular plate 19 is bolted to the upper ends, one on the front faces and one on the back faces, of side members 14 to form the upper end of frame 13. Die block assembly 11, described in more detail below, fastens to the lower ends of side members 14, to complete rectangular frame 13.

Figure 2:
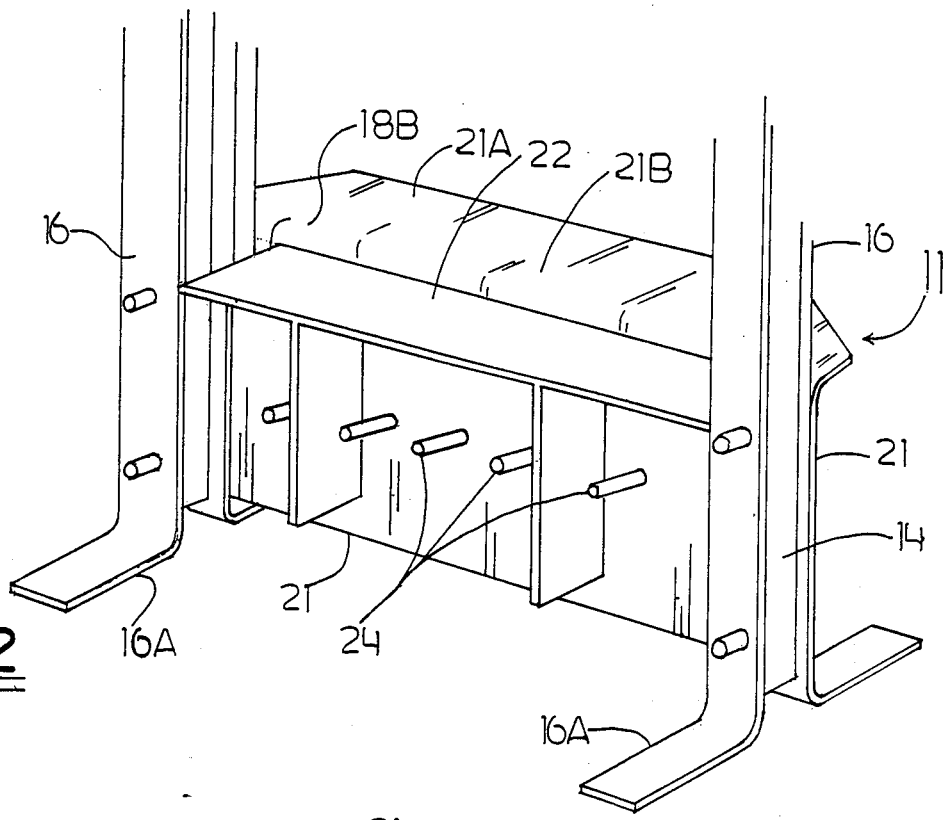
FIG. 2 is a perspective view of the lower portion of the invention of FIG. 1, with a front panel removed.

Referring now to FIGS. 1 and 2, die block assembly 11 is comprised of two vertical plates 21, one bolted to the front faces of front brackets 16 and one bolted to the back faces of rear brackets 16, and held in a parallel spaced-apart relation by a double-tee member 22.

Each plate 21 is bent outwardly at its upper end **21*a* to a 90 degree angle, the bent upper portions 21*a* thereby falling within a horizontal plane. It should be noted that bending a single sheet of metal to form bent plate 21, as opposed to attaching two separate sheets in a butt-joint, naturally forms a uniform radius curve on the exterior surface of the bend 21*b*. Athough the dimension of the radius of curved bend 21*b* is not critical, the fact that it is curved rather than sharp is crucial when operating the invention 10**, as will be described in more detail below. This novel method of forming a die block allows the maufacturer to use conventional, inexpensive materials, rather than the machined die block previously described.

Each plate 21 has a pair of spaced-apart triangular shaped planar supports 23 affixed with one leg of the triangle perpendicular to the vertical surface of plate 21, and the other leg perpendicular to the bent surface **21*a*. Supports 23 will thereby assist in maintaining the bent surface 21*a* in position when weight is placed thereon. Double-tee 22 has a width equal to the width of the vertical slot between plates 21, the head of the double tee 22 extending between the interior vertical sides of leg brackets 16. Double-tee 22 is inserted between the vertical faces of plates 21 and is held in place with bolts 24 extending through both plates 21 and compressing plates 21 along the edges of double-tee 22**.

Referring again to FIG. 1, die blade assembly 12 is comprised of a blade 26 having angle members 27 affixed on either side thereof. Thus, one leg of each member 27 is oriented perpendicular to and outward from its top edge, forming a horizontal platform 28. Two spring-mounted hooks 29 are connected at either end of blade 26 and support it from top plates 19 of frame 13.

Figure 4:
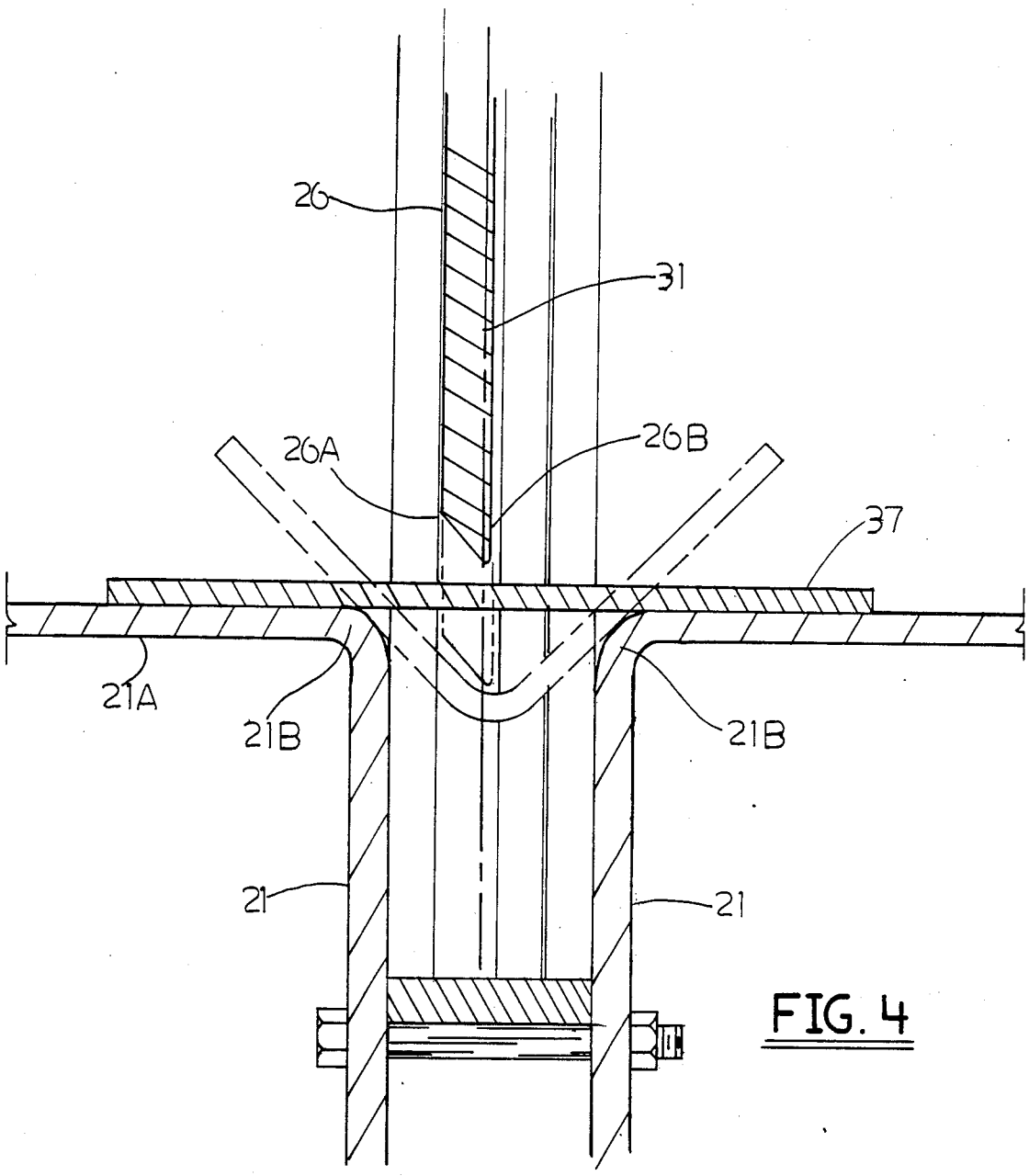
FIG. 4 is a supra-enlarged sectional view of the invention taken at lines 4—4 in FIG. 3.

Die blade 26 is generally rectangular in shape and extends between the interior faces of side members 14. It is of a thickness such that it will slide within each channel 17 formed along the lower portion of side members 14. As seen in FIG. 4, the lower edge 26*a* of blade 26 is beveled to form a bead 26*b* with a radius having its center line within a vertical plane 31 centered between the parallel vertical faces of plates 21.

A pushing block 36 is mounted to the bottom of top plates 19, such that a conventional hydraulic jack resting on platform 28 may extend upwards to push against pushing block 36, thereby forcing platform 28 downwards. Pushing block 36 is comprised of a rectangular plate 36*a* which extends beyond each edge of top plates 19 to form a large flat base. Plate 36*a* is affixed to an upper block 36*b* having narrower dimensions, such that it may slide between plates 19. Plate 36*a* is fastened in place via a bolt 36*c* projecting through plates 19 and block 36*b*.

Referring now to FIG. 4, a piece of flat metal stock 37 is positioned upon the horizontal portions 21*a* of plates 21 with the site of the desired bend centered between the parallel vertical faces of plates 21.

As jack 15 (not shown) is extended, the bead 26*b* of blade 26 will bear against the metal stock 37. As blade 26 continues downward, metal stock 37 will bend at the point of contact with blade 26; the face of metal stock 37 remaining tangent with the curved radius bends 21*b* of die plates 21 (see phantom lines). The uniform radius bends 21*b* allow metal stock 37 to slide downwards as it is being bent, thereby by protecting against one or the other side catching and causing a non-uniform bend. A sharp edge rather than the curved bend 21*b*, would also scrape or dent metal stock 37,—an obviously undesirable result. Since bead 26*b* of blade 26 is centered between plates 21, the bend in metal stock 37*a*, will be uniform. Blade 26 is pushed downwards until the desired angle of bend in metal stock 37 is obtained. As jack 15 is reversed, spring-mounted hooks 29 will raise jack 15 and blade 26 away from metal stock 37, allowing removal of the bent metal 37.

By using a slidable die blade assembly 12, the weight of jack 15 is added to the amount of pressure which may be supplied to die blade 26 thus increasing the capacity of the metal bending device 10, without requiring an increase in materials or structure.

It should also be noted that leg brackets 16 only extend approximately half-way up side members 14. This allows the operator to remove die blade assembly 12 from frame 13. Then, jack 15 may rest on the bent portions 21*a* of plates 21, and be operated against pushing block 36 in a manner similar to conventional power presses.

It will be readily understood that the particular disposition or arrangement or nature of the elements of the invention are not of the essence of the invention, and that many variations, substitutions, and modifications may be made, in departure from their particular construction and characterization in the drawings and foregoing description, without departing from the true spirit of the invention. It is therefore to be understood that the invention should be limited only by the breadth and scope of the appended claims.

What is claimed is:

1. A device for bending metal stock, comprising:

a die block, including two plates, the lower portions of which are vertical and the upper portions of which are bent outwardly to a generally horizontal position, the exterior face of each bend in said plates being substantially an arc of a circle, and means for affixing the lower portions in parallel spaced-apart relation to form a slot therebetween and for affixing the upper portions in the same plane;

a vertical guide member affixed to each end of said die block;

a die blade, slidably mounted between said guide members for movement in a plane centered between the vertical portions of the plates of said die block; and means for selectively powering said die blade towards said die block.

2. The device for bending metal stock as stated in claim 1, further comprising a rigid horizontal member connecting the upper ends of said guide members and thereby forming a generally rectangular frame, and wherein said die blade powering means is extendable between said die blade and said horizontal member to force said die blade away from said horizontal member.

3. The device for bending metal stock as stated in claim 1, further comprising means for biasing said die blade away from said die block.

4. The device for bending metal stock as stated in claim 1, further comprising:

a side member affixed to each said guide member and extending beyond the ends of said guide members;

a rigid horizontal member connecting the upper ends of said side members and thereby forming a generally rectangular frame; and wherein said blade powering means is extendable between said die blade and said horizontal member to force said die blade away from said horizontal member; whereby said die blade may be removed from said guide members and the device may be used as a conventional power press.

5. The device for bending metal stock as stated in claim 2, wherein said selective powering means is a conventional hydraulic jack.

6. The device for bending metal stock as stated in claim 4, wherein said selective powering means is a conventional hydraulic jack.

7. The device for bending metal stock as stated in claim 2, further comprising means for biasing said die blade away from said die block.

8. The device for bending metal stock as stated in claim 4, further comprising means for biasing said die blade away from said die block.

9. The device for bending metal stock as stated in claim 5, further comprising means for biasing said die blade away from said die block.

10. The device for bending metal stock as stated in claim 6, further comprising means for biasing said die blade away from said die block.

11. A die block of the type used with a die blade in bending metal stock, formed by a process comprising the steps of:

bending a first plate to an approximate right angle, the exterior face of the bend being substantially an arc of a circle;

bending a second plate to an approximate right angle, the exterior face of the bend being substantially an arc of a circle;

positioning said first plate with one leg parallel to a leg of said second plate and the other leg of said first plate in the same plane as the other leg of said second plate, said coplanar legs facing outwardly from the slot formed by said parallel legs;

inserting spacer means between said parallel legs; and affixing the parallel legs of said plates together, with said spacer therebetween.

* * * * *